US006151850A

United States Patent [19]

Sorkin

[11] Patent Number: 6,151,850

[45] Date of Patent: Nov. 28, 2000

[54] INTERMEDIATE ANCHORAGE SYSTEM UTILIZING SPLICE CHUCK

[76] Inventor: Felix L. Sorkin, P.O. Box 1503, Stafford, Tex. 77477

[21] Appl. No.: 09/299,258

[22] Filed: Apr. 26, 1999

[51] Int. Cl.[7] ..... E04C 5/08

[52] U.S. Cl. ..... 52/223.13; 52/223.1; 52/223.14; 52/583.1; 52/745.21; 52/745.19

[58] Field of Search ..... 52/223.1, 223.6, 52/223.13, 223.14, 745.21, 745.05, 745.19, 742.14, 583.1, 726.1

[56] References Cited

U.S. PATENT DOCUMENTS

| | | | |
|---|---|---|---|
| 1,385,606 | 7/1921 | Christensen . | |
| 2,386,473 | 10/1945 | Kanary | 52/726.1 X |
| 4,694,621 | 9/1987 | Locke | 52/726.1 X |
| 4,773,198 | 9/1988 | Reinhardt | 52/223.1 |
| 5,079,879 | 1/1992 | Rodriguez | 52/223.1 |
| 5,271,199 | 12/1993 | Northern | 52/223.13 |
| 5,749,185 | 5/1998 | Sorkin . | |
| 5,775,849 | 7/1998 | Sorkin . | |
| 5,897,102 | 4/1999 | Sorkin | 52/223.13 X |
| 5,967,691 | 10/1999 | Lancelot, III | 52/726.1 X |

*Primary Examiner*—Beth A. Stephan
*Assistant Examiner*—Brian E. Glessner
*Attorney, Agent, or Firm*—Harrison & Egbert

[57] ABSTRACT

A post-tension anchor system having a first tendon with a sheathed portion and an unsheathed portion, a second tendon with a sheathed portion and an unsheathed portion, an anchor receiving the first tendon therein so as to have the unsheathed portion of the first tendon extending outwardly from one end of the anchor, a splice chuck receiving the unsheathed portion of the first tendon at one end thereof and receiving the unsheathed portion of the second tendon at an opposite end thereof, and a cover extending over the splice chuck so as to have one end extending in liquid-tight relationship with the sheathed portion of the second tendon. The cover also includes a cap member formed at an opposite end which is engaged within the cap-receiving section of the encapsulation of the anchor. The cover includes a polymeric section extending around a portion of the body of the splice chuck and the opposite end of the splice chuck and an elastomeric portion extending around another portion of the body and the other end of the splice chuck. The elastomeric portion overlaps an end of the polymeric portion in liquid-tight relationship therewith.

18 Claims, 3 Drawing Sheets

INTERMEDIATE ANCHORAGE SYSTEM UTILIZING SPLICE CHUCK

TECHNICAL FIELD

The present invention relates to post-tensioning systems. More particularly, the present invention relates to post-tensioning systems having intermediate anchorages. Furthermore, the present invention relates to sealing devices for preventing liquid intrusion into the exposed sections of tendon in the post-tension system.

BACKGROUND ART

For many years, the design of concrete structures imitated the typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete maybe constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as one hundred feet can be attained in members as deep as three feet for roof loads. The basic principle is simple. In pre-stressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

There are many post-tension systems employing intermediate anchorages where the length of the slab is too long to tension with a single anchor. In these systems, the intermediate anchor is interposed between a live end and a dead end anchor. In the construction of such intermediate anchorage systems, the tendon extends for a desired length to the intermediate anchor. A portion of the sheathing is removed in the vicinity of the intermediate anchor. The intermediate anchor is installed onto a form board in accordance with conventional practice. The unsheathed portion of the tendon is received by a tensioning apparatus such that the tendon is stressed in the area between the dead end anchor and the intermediate anchor. After stressing the tendon, concrete is poured over the exterior of the sheathed tendon and over the dead end anchor and intermediate anchor. The remaining portion of the tendon extends from the intermediate anchor to either another intermediate anchorage or to the live end anchor. Intermediate anchorage systems are employed whenever the slab is so long that a single live anchor extending to a single dead end anchor is inadequate. For example, two intermediate anchorages would be used for slabs having a length of approximately 300 feet.

A problem that affects many of the intermediate anchorage systems is the inability to effectively prevent liquid intrusion into the unsheathed portion of the tendon. Normally, the unsheathed portion will extend outwardly, for a distance, from the intermediate anchor in the direction toward the dead end anchor. Additionally, another unsheathed portion will extend outwardly at the intermediate anchor toward the live end anchor. In normal practice with a single live anchor and without intermediate anchors, a liquid-tight tubular member is placed onto an end of the anchor so as to cover the unsheathed portion of the tendon. This is relatively easy to accomplish since the length of the tendon is minimal at the live end. However, it is a considerable burden to attempt to slide such a tubular member along the entire length of the tendon so as to form the liquid-tight seal at the intermediate anchorage. In normal practice, tape, or other corrosion protection materials, are applied to the exposed portion of the tendon adjacent the intermediate anchorage. Extensive practice with this technique has shown that it is generally ineffective for preventing liquid intrusion into the interior of the tendon or into the interior of the intermediate anchorage. As such, a great need has developed in which to protect the exposed areas of the tendon adjacent the intermediate anchorage.

A problem inherent in such continuous tendon intermediate anchorage systems is the difficulty of installation.

Conventionally, in order to install the great lengths of tendon associated with such an intermediate anchorage systems, it is necessary for the worker at the construction site to thread the anchor along the length of the tendon so as to place the anchor in a desired position. Often during this "threading" of the anchor onto the tendon, nicks and damage can occur to the sheathing on the tendon. Often, components of the intermediate anchorage system are omitted or the installation is carried out in an ineffective manner because of the large amount of manual manipulation that is required for the installation of the system. Inherently, each of the intermediate anchors will be located in a joint of the concrete structure. As such, each of the anchors will be exposed to the corroding elements in this location. The liquid resistance of the intermediate anchorage system must be particularly good so as to prevent any damage to the exposed portions of the tendon.

In one form of the installation of post-tension systems, a "splice chuck" is used so as to secure the end of one tendon to the end of a next in-line tendon. Conventionally, the splice chuck will be joined to the unsheathed portion of a first tendon and joined to the unsheathed portion of a second tendon. The use of wedges, springs and other components of the splice chuck will assure that one end of the first tendon is securely joined to the opposite end of the next in-line tendon. After the splice chuck is used to join the ends of the tendons in proper relationship, the concrete can be poured over the tendons and the splice chuck. Unfortunately, because of the use of springs, wedges and other components in the splice chuck, the splice chuck is particularly susceptible of corrosion and deterioration. The weakening of any component within the splice chuck, such as the spring, can cause the integrity of the splice chuck to become compromised and, possibly, release the end of one tendon from the end of an adjoining tendon. The exposure of the splice chuck to the corroding elements is particularly important since, as stated previously, the intermediate anchorage will inherently appear at a joint in the concrete structure.

The splice chuck can solve the problems associated with the extremely long strands or tendons throughout the concrete structure. In effect, shorter lengths of tendons can be installed and joined in secure end-to-end relationship by the use of a splice chuck. The anchors can be preinstalled onto the tendon prior to delivery to the construction site. The use of the splice chuck eliminates the need for workers to "thread" the anchor, and the other components, along the extended lengths (up to five hundred feet) of the tendon. Unfortunately, the splice chucks have not been able to be used as part of an intermediate anchorage system in which encapsulated systems are required.

It is an object of the present invention to provide a post-tension anchorage system which effectively prevents the intrusion of corroding elements into the interior of the system.

It is another object of the present invention to provide a post-tension system which effectively prevents the exposure of the splice chuck to the corroding elements.

It is another object of the present invention to provide an intermediate anchorage for a post-tension anchor system which eliminates the need for extended lengths of tendon.

It is a further object of the present invention to provide a post-tension system which eliminates the need to "thread" the anchor along an extended length of tendon.

It is still a further object of the present invention to provide a post-tension system which is easy to install and easy to use.

It is a further object of the present invention to provide an intermediate anchorage system which reduces labor requirements for installation.

These and other objects and advantages of the present invention will become apparent from a reading of the attached specification and appended claims.

SUMMARY OF THE INVENTION

The present invention is a post-tension anchor system comprising a first tendon with a sheathed portion and an unsheathed portion, a second tendon with a sheathed portion and an unsheathed portion, an anchor receiving the first tendon therein and having the unsheathed portion extending outwardly from one end of the anchor, a splice chuck receiving the unsheathed portion of the first tendon at one end thereof and receiving the unsheathed portion of the second tendon at an opposite end thereof, and a cover extending over the splice chuck so as to have one end extending in liquid-tight relationship with the sheathed portion of the second tendon.

In the preferred embodiment of the present invention, the anchor has an encapsulation extending thereover. The encapsulation has a cap-receiving section formed at one end thereof. The cover has an end which is engageable with the cap-receiving section in liquid-tight relationship therewith. The cover, in particular, includes a cap member which is formed so as to be engageable within the cap-receiving section of the encapsulation. The extends around the unsheathed portion of the first tendon.

In the present invention, the cover includes a polymeric portion extending around the body of the splice chuck and over one end of the splice chuck and outwardly therefrom, and an elastomeric portion extending around another portion of the body of the splice chuck and over the opposite end of the splice chuck. The elastomeric portion overlaps an end of the polymeric portion in liquid-tight relationship therewith. The elastomeric portion has a narrow area which extends in liquid-tight relationship around the sheathed portion of the second tendon. Grease may be interposed between the exterior of the splice chuck and the interior of the polymeric portion and the elastomeric portion.

The present invention is also a method of forming an intermediate anchorage of a post-tension system which comprises the steps of: (1) extending a tendon with one end of the tendon affixed to a first anchor and another end of the tendon affixed to a second anchor; (2) pouring concrete over the tendon; (3) solidifying the concrete over the tendon; (4) tensioning the tendon such that an unsheathed portion of the tendon extends outwardly of the second anchor; (5) affixing a splice chuck to the unsheathed portion of the tendon in liquid-tight relationship therewith; and (6) affixing another tendon into the splice chuck such that this tendon extends outwardly of the splice chuck in liquid-tight relationship therewith.

In this method of the present invention, a cover is affixed over the splice chuck such that one end of the cover extends in liquid-tight relationship with the sheathed portion of a tendon. The cover is also formed so as to have a cap which is engageable within a cap-receiving area formed in the second anchor.

This method of the present invention further includes the steps of affixing a third anchor to an opposite end of the tendon extending from the splice chuck, pouring concrete over the splice chuck and this tendon, solidifying the concrete over the splice chuck and this tendon, and tensioning this tendon such that an unsheathed portion of this tendon extends outwardly of the third anchor on a side opposite the splice chuck. The splice chuck is assembled by placing the splice chuck within a polymeric portion of the cover and extending an elastomeric portion in overlapping liquid-tight relationship over the remaining portion of the splice chuck and over the polymeric portion.

DETAILED DESCRIPTION OF THE PRESENT INVENTION

Figure 1:
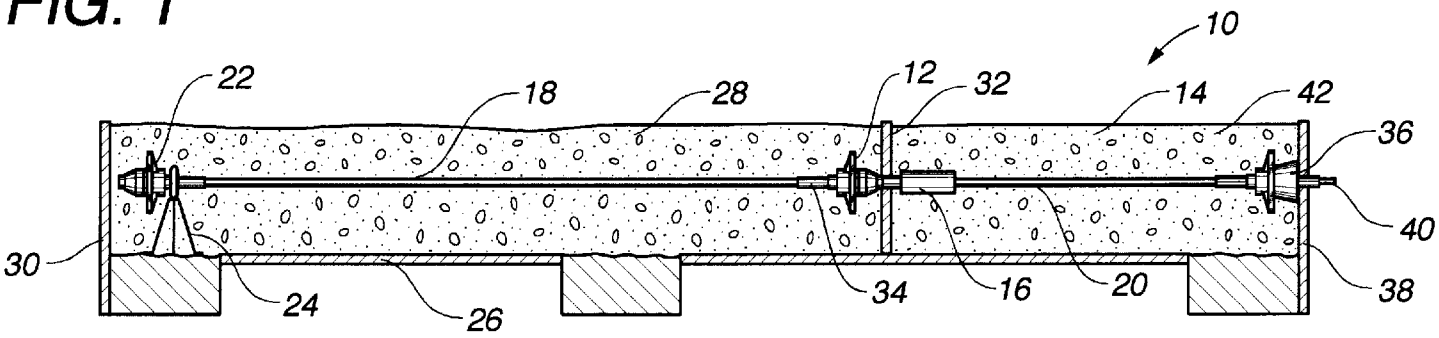
FIG. 1 is a diagrammatic illustration of the installation of the intermediate anchorage in accordance with the method of the present invention.

Referring to FIG. 1, there is shown at 10 a post-tension anchor system employing an intermediate anchorage 12 located within the interior of a concrete structure 14. The present invention is a method of installing the intermediate anchorage 12 through the use of a covered splice chuck 16 located adjacent to the intermediate anchorage 12 of the post-tension system 10. The post-tension system 10 illustrates the use of a first tendon 18 and a second tendon 20.

In the method of the present invention, a first anchor 22 is positioned on a support 24 extending above the floor 26. One end of the first tendon 18 is received within the anchor 22 and extends outwardly therefrom. The opposite end of the tendon 18 is received within the intermediate anchorage 12. Conventionally, a form board will be placed adjacent to the intermediate anchorage 12 so as to allow for the pouring of the concrete 28 in the area between the intermediate anchorage 12 and over the end of the dead end anchor 22. Eventually, the concrete 28 will be solidified in the area between the form board 30 and joint 32. An unsheathed portion of the first tendon 18 will extend through the interior of the anchor 12 and outwardly past the area of joint 32. The intermediate anchor 12 is encapsulated with a polymeric material. A plastic tubular member 34 extends from the anchor 12 over an unsheathed portion of the first tendon 18.

Once the concrete 28 has suitably solidified, the unsheathed portion of the first tendon 18 extending past the end of the anchor 12 can be suitably tensioned by an appropriate tensioning device. The tensioning device must act on the unsheathed portion of the first tendon 18 extending outwardly from the anchor 12. After the tensioning has been completed, the tendon 18 will reside within the concrete 28 in a tensioned condition.

So as to join the first tendon 18 to the second tendon 20 in end-to-end relationship, the unsheathed tensioned end of the first tendon 18 is cut and inserted into the splice chuck 16. Similarly, an unsheathed portion of the second tendon 20 will be inserted into an opposite end of the splice chuck 16. As will be described hereinafter, the splice chuck 16 includes a cover having a cap which is adapted for receipt within the adjacent end of the anchor 12. The cover will also extend over the sheathed portion of the second tendon in liquid-tight relationship therewith. The second tendon 18 can then extend from the intermediate anchor 12 to a third anchor 36. The third anchor 36 is secured to the form board 38. The unsheathed end 40 of the second tendon 20 extends outwardly of the form board 38 from the anchor 36. The concrete 42 is then poured into the area between the joint 32 and the form board 38 and allowed to solidify. Once the concrete 42 has solidified, the unsheathed end 40 of the second tendon 20 can be appropriately tensioned. As such, the present invention provides a method of forming an intermediate anchorage 12 which includes separate tendons 18 and 20 arranged in end-to-end relationship. It should also be noted that the unsheathed end 40 of the second tendon can also be joined in end-to-end relationship in the manner described hereinbefore in association with the intermediate anchorage 12 and the splice chuck 16. As such, an extended length of the post-tension system can be created by using the method of the present invention.

Figure 2:
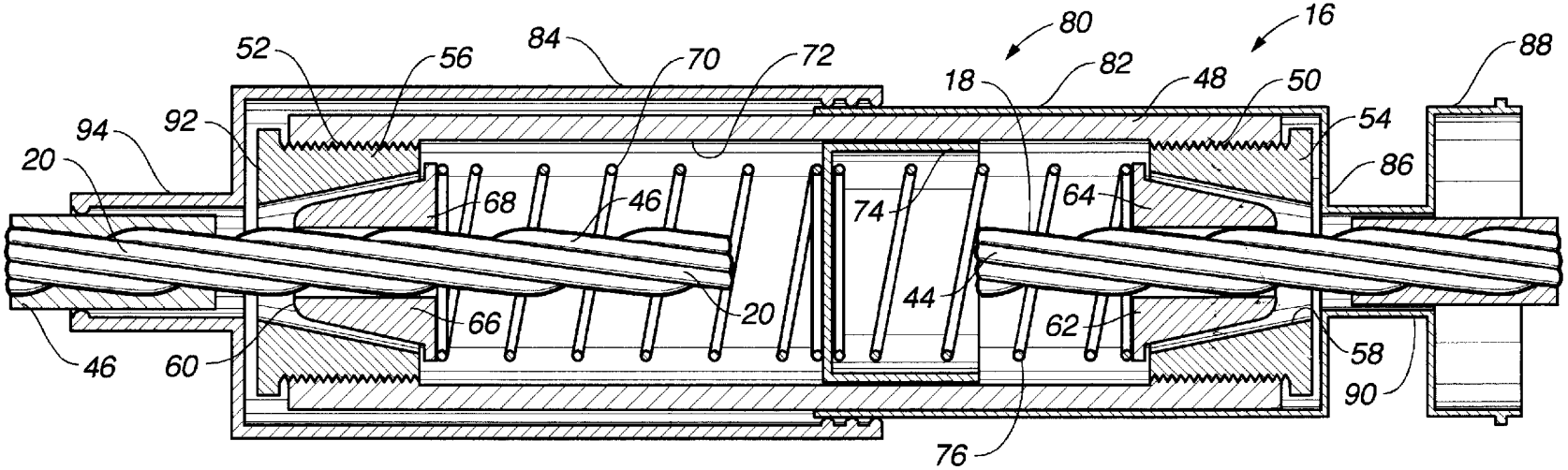
FIG. 2 is a cross-sectional view showing the apparatus of the present invention.

FIG. 2 illustrates the interior of the splice chuck 16 which is used to received the unsheathed end 44 of the first tendon 18 and the unsheathed end 46 of the second tendon 20. The body 48 of the splice chuck 16 is of a conventional configuration. The body 18 has a generally tubular configuration with threaded area 50 at one end and threaded area 52 at an opposite end. A collar 54 is received within threaded end 50 of body 48. Similarly, a collar 56 is threadedly received within the threaded end 52 of body 48. The collars 54 and 56 have tapered interiors 58 and 60, respectively. Wedges 62 and 64 are received within the tapered interior 58 of collar 54. Similarly, wedges 66 and 68 are received within the tapered interior 60 of collar 56. A first spring 70 is positioned within the interior 72 of the body 48 of splice chuck 16. Spring 70 will reside against a surface of the cap 74 located on the interior 72 of body 48. Spring 70 will exert a force onto the end of the wedges 66 and 68 so as to urge the wedges into the interior 60 of the collar 56. Similarly, a spring 76 will be received by the interior cap 74 and will exert a force onto the ends of the wedges 62 and 64 so as to urge the wedges 62 and 64 into the tapered interior 58 of the collar 54.

As can be seen, the unsheathed portion 44 of the first tendon 18 is received within the space between the wedges 62 and 64 and within the interior tapered cavity 58 of the collar 54 at one end of the splice chuck 48. Similarly, the unsheathed portion 46 of the second tendon 20 is received between the wedges 66 and 68 within the tapered interior cavity 60 of the collar 56. When a tension force is exerted on either or both of the tendons 18 and 20, the respective wedges will be drawn into the tapered interior cavities of the respective collars so as to establish a strong interference fit relationship with the cavity and to securely engage the respective tendons therein. The use of the springs 70 and 76 assures that the unsheathed ends 44 and 46 ofthe tendons 18 and 20 can be easily inserted into the respective open ends of the splice chuck 16.

In FIG. 2, it can be seen that a cover 80 extends over the body 48 ofthe splice chuck 16. The cover 80 includes a polymeric portion 82 and an elastomeric portion 84. The polymeric portion 82 extends over a portion of the body 48 and over end 86 of the splice chuck 16. The polymeric portion 82 can be suitably injection molded so as to form a cap area 88 at one end thereof. Cap area 88, along with the intervening neck area 90, extends around the unsheathed portion 44 of the tendon 18. Cap 88 is suitable for threaded or snap-fit receipt within the cap-receiving portion formed on the intermediate anchor 12. As such, the cap 88 can be suitably inserted into this cap-receiving portion of the encapsulation of anchor 12 so as to establish a secure liquid-tight relationship therewith. The unsheathed portion 44 of the tendon 18 will reside within the interior of the polymeric portion 82. It should be noted that the interior of the polymeric portion 82 can be suitably filled with a grease so as to further establish strong liquid-resistant qualities of the interior of the polymeric portion 82.

The elastomeric portion 84 of cover 80 will overlap an end of the polymeric portion 82 and will extend along the remainder of the body 84 so as to extend downwardly over the end 92 of the body 84. The elastomeric portion 84 includes a narrowed area 94 at the end 92 of body 84 which extends downwardly so as to be in liquid-tight engagement with the sheathed portion 96 of the tendon 20. As such, liquid intrusion is effectively prevented from entering the splice chuck 16 through the openings at the end 92 of the body 84.

Figure 3:
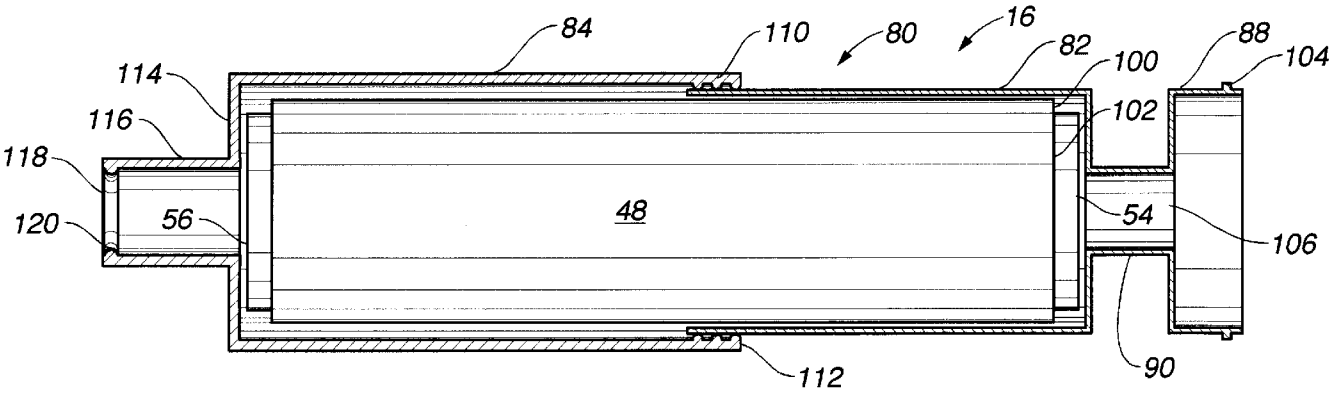
FIG. 3 is a cross-sectional view showing the receipt of the splice chuck within the interior of the cover.

FIG. 3 shows the splice chuck 16 prior to the installation of the respective tendons 18 and 20. As can be seen, the polymeric portion 82 of the cover 80 extends outwardly beyond the end 100 of the body 48 of the splice chuck 16. Within the preferred embodiment of the present invention, the polymeric portion 82 does not reside in compressive engagement with the body 84 but, in fact, can be a loose fit therewith. The polymeric portion 82 has a radially inwardly extending portion 102 which will extend over the end 100 of the body 48. A neck area 90 will extend longitudinally outwardly from this radially inwardly extending portion 102. The cap 88 is then formed so as to extend radially outwardly from the neck portion 90. Engagement threads 104 are formed on the periphery of the cap 88 so as to suitably engage formed within the cap-receiving portion ofthe polymeric encapsulation ofthe anchor. An interior passage 106 is formed through the interior of the cap 88 and the neck portion 90 so as to allow the tendon to be inserted within the opening formed on the collar 54. The elastomeric portion 84 of the cover 80 is secured in overlapping liquid-tight engagement with the exterior of the polymeric portion 82 in area 110. If necessary, small O-ring seals 112 can be installed in the area between the elastomeric portion 84 and the exterior of the polymeric portion 82. The elastomeric portion 84 will extend over the remainder of the body 84 and converge inwardly at end 114 so as to form neck area 116. Neck area 116 will open at end 118 so as to allow for the insertion ofthe tendon therein. A suitable inwardly extending seal portion 120 is formed at end 118 so as to further establish the proper liquid-tight sealing relationship between the elastomeric portion 84 and the sheathed portion of the tendon extending therethrough. The tendon can be easily inserted through the opening 118 and into the opening associated with the collar 56 at the end of the body 84.

Figure 4:
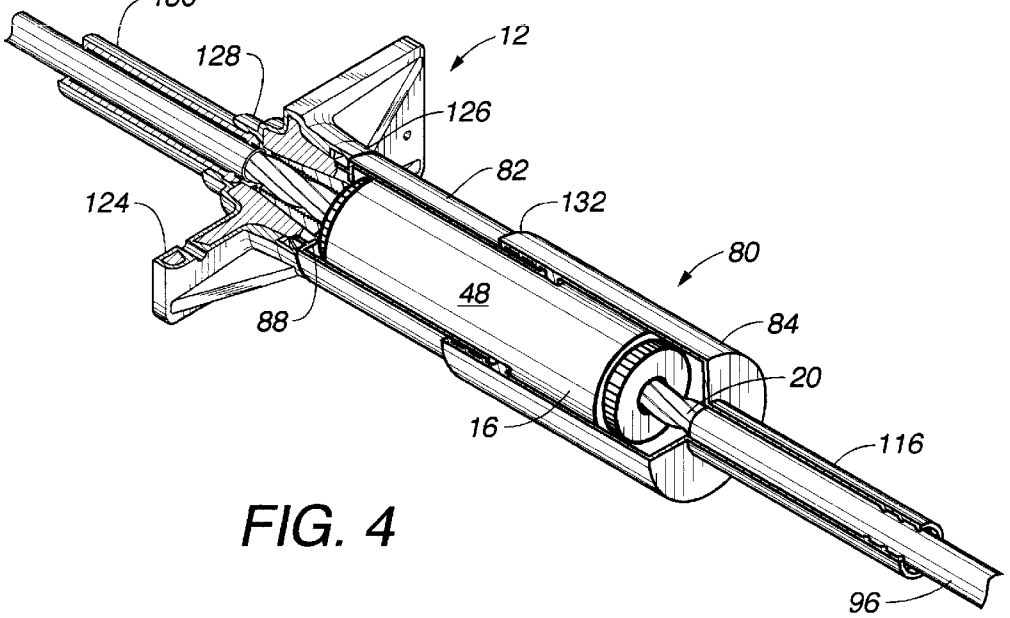
FIG. 4 is a perspective partially cross-sectional view showing the installation of the present invention within an encapsulated anchor.

FIG. 4 illustrates the present invention as installed within the anchor 12. As can be seen in detail, the anchor 12 has an encapsulation 124 extending thereover. The anchor 12 includes a cap-receiving portion 126 formed of the polymeric encapsulation 124. A conventional steel anchor will be formed on the interior of the encapsulation 124. A tubular section 128 extends outwardly from one end of the encapsulation 124 associated with anchor 12. A tube 130 can be attached to this tubular section 128 in liquid-tight engagement therewith. Tube 130 will extend over an unsheathed portion of the tendon entering into the interior of the anchor 12.

In FIG. 4, it can be seen that the cap 88 will be received within the cap-receiving portion 126 of the encapsulation 124 of anchor 12. The elastomeric portion 84 will have an end 132 extending completely around and over the exterior of the polymeric portion 82 so as to establish a liquid-tight relationship therewith. The neck area 116 of the elastomeric portion 84 extends downwardly so as to establish a liquid-tight relationship with the sheathed portion 96 of the tendon 20. In this manner, the cover 80 effectively prevents liquid from intruding into the interior of the cover 80 and into the interior of the body 48 of the splice chuck 16.

By the use the present invention, an intermediate anchorage can be established by simply joining tendons in end-to-end relationship. Unlike the prior art, the present invention allows for long lengths of tendon to be connected in end-to-end relationship through the use of the splice chuck. However, the present invention retains the proper liquid-resistant qualities ofthe post-tension anchor system by covering the splice chuck so as to prevent liquid intrusion from occurring therewith. The splice chuck is suitably joined with the encapsulated anchor body so as to present a secure and sealed area over the exposed portions of the tendon received therein. The present invention only allows the sealed and sheathed portions of the tendon to emerge from the anchor body or from the splice chuck. As such, the present invention provides an encapsulated system for an intermediate anchorage.

Figure 5:
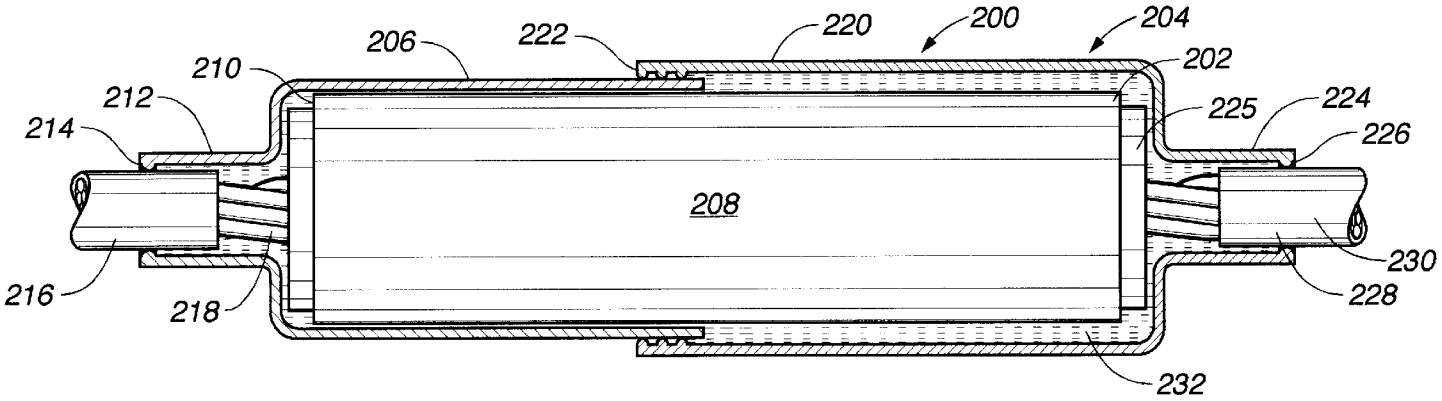
FIG. 5 is a partially cross-sectional view showing an alternative form of the present invention.

FIG. 5 shows an alternative embodiment 200 of the present invention. In the embodiment 200, it should be noted that the splice chuck 202 is of an identical configuration to that described herein previously. It is the cover 204 that differs between the prior preferred embodiment of the present invention and this alternative embodiment 200.

In the alternative embodiment 200, a first elastomeric portion 206 will extend over a portion of the body 208 of the splice chuck 202 and over the end 210 of the body 208. The first elastomeric portion 206 will have a neck area 212 of narrow diameter emerging from the end 210 of the splice chuck 202. This narrow neck portion 212 can have a sealing end 214 which is suitable for establishing a liquid-tight seal with the sheathing 216 associated with a tendon 218. Similarly, a second elastomeric portion 220 can reside in overlapping relationship at 222 with the first elastomeric portion 206. The second elastomeric portion 220 will extend over the remaining portion of the body 208 of splice chuck 202. The second elastomeric portion 222 will narrow to a neck portion 224 over the end 225 of the body 208. This neck portion 224 will include a sealing element 226 which will engage the exterior of the sheathing 228 of tendon 230 in liquid-tight relationship therewith. Grease 232 is inserted into the area between the exterior of the body 208 and the interior of the cover 204.

Figure 6:
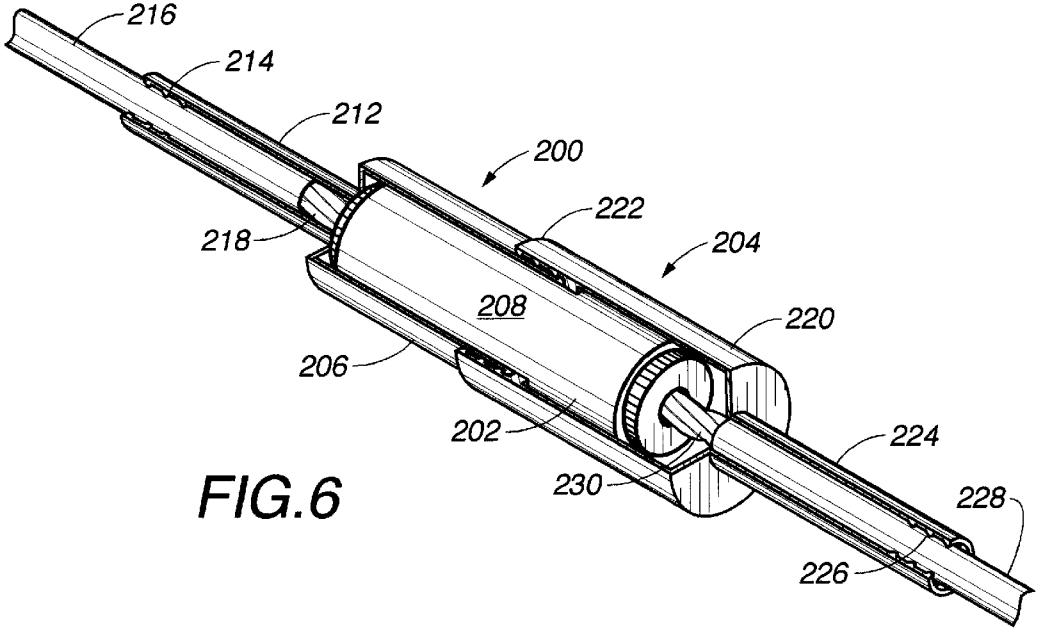
FIG. 6 is a perspective partially cross-sectional view showing the installation of this alternative embodiment of the present invention.

FIG. 6 shows a perspective view, in partial cross-section under alternative embodiment 200 of the present invention. In the alternative embodiment 200, as shown in FIG. 6, it can be see how the splice chuck 202 can be used so as to join the unsheathed ends of tendons 218 and 230 together. As such, it can be seen how the present invention can be used in place of conventional anchorages in post-tension construction and can be used for the repair of existing lengths of tendons. In FIG. 6, it can further be seen that it is possible, within the concept of the present invention, for the first elastomeric portion 206 and the second elastomeric portion 222 to be formed of a polymeric material in the manner described herein previously. It can be further seen in FIG. 6 that the splice chuck 202 can reside in a relatively "loose" relationship within the interior of the cover 204. Since the cover 204 includes sealing elements 214 and 226 at its ends, the splice chuck 202 does not have to be securely fitted within the cover 204. These can be optionally used so as to fill the voids within the interior of the cover 204.

In the embodiment 200 of the present invention, the splice chuck 202 can be appropriately used so as to join the ends of tendons 216 and 230 in end-to-end relationship. As such, the present invention can be used so as to connect portions of a post-tension system which may be damaged or severed. Furthermore, the present invention enhances the integrity of the splice chuck 202 by placing the cover around the exterior of the splice chuck and maintaining this cover in liquid-tight relationship with the connected tendons 216 and 230. Furthermore, this embodiment of the present invention allows the splice chuck 202 to be used as part of an intermediate anchorage system at any location along the extended length ofthe tendon. The present invention can be used in the event that shorter lengths of tendons are provided than those which are required at the construction site. The cover 204, as recited in this form ofthe present invention, is not particularly adapted for joining with an anchor of the post-tension anchor system.

The foregoing disclosure and description of the invention is illustrative and explanatory thereof. Various changes in the details of the illustrated construction can be made within the scope of the appended claims without departing from the true spirit ofthe invention. The present invention should only be limited by the following claims and their legal equivalents.

I claim:

1. A post-tension anchor system comprising:

a first tendon with a sheathed portion and an unsheathed portion;

a second tendon with a sheathed portion and an unsheathed portion;

an anchor receiving said first tendon therein, said first tendon having said unsheathed portion extending outwardly from one end of said anchor said anchor having an encapsulation extending thereover, said encapsulation having a cap-receiving section at one end thereof;

a splice chuck receiving said unsheathed portion of said first tendon at one end thereof and receiving said unsheathed portion of said second tendon at an opposite end thereof; and a cover extending over said splice chuck, said cover having one end extending in liquid-tight relationship with said sheathed portion of said second tendon, said cover having an opposite end engaged with said cap-receiving section in liquid-tight relationship therewith.

2. The system of claim 1, said cover having a cap member formed at said opposite end, said cap member engaged with said cap-receiving section of said encapsulation.

3. The system of claim 2, said cap member having a neck section extending therefrom, said cap member and said neck section extending over said unsheathed portion of said first tendon.

4. A post-tension anchor system comprising:

a first tendon with a sheathed portion and an unsheathed portion;

a second tendon with a sheathed portion and an unsheathed portion;

an anchor receiving said first tendon therein said first tendon having said unsheathed portion extending outwardly from one end of said anchor;

a splice chuck receiving said unsheathed portion of said first tendon at one end thereof and receiving said unsheathed portion of said second tendon at an opposite end thereof; and a cover extending over said splice chuck said cover having one end extending in liquid-tight relationship with said sheathed portion of said second tendon said cover comprising:

a polymeric portion extending around a portion of the body of said splice chuck and said opposite end of said splice chuck and extending outwardly therefrom; and an elastomeric portion extending around another portion of said body and said one end of said splice chuck, said elastomeric portion overlapping an end of said polymeric portion.

5. The system of claim 4, said elastomeric portion having a narrow end extending around said sheathed portion of said second tendon.

6. The system of claim 4, said elastomeric portion overlapping said polymeric portion in liquid-tight relationship.

7. The system of claim 4, further comprising:

a grease interposed between an exterior of said splice chuck and an interior of said polymeric portion and said elastomeric portion.

8. A post-tension anchor system comprising:

a first tendon with a sheathed portion and an unsheathed portion;

a second tendon with a sheathed portion and an unsheathed portion;

an anchor receiving said first tendon therein said first tendon having said unsheathed portion extending outwardly from one end of said anchor;

a splice chuck receiving said unsheathed portion of said first tendon at one end thereof and receiving said unsheathed portion of said second tendon at an opposite end thereof; and a cover extending over said splice chuck said cover having one end extending in liquid-tight relationship with said sheathed portion of said second tendon said cover comprising:

a first elastomeric portion extending around a portion of a body of said splice chuck and said opposite end of said splice chuck and outwardly therefrom; and a second elastomeric portion extending around another portion of said body and said one end of said splice chuck, said second elastomeric portion overlapping an end of said first elastomeric portion.

9. The system of claim 1, said cover having an opposite end in liquid-tight relationship with said sheathed portion of said first tendon.

10. A connector for tendons of a post-tension system comprising:

a splice chuck having a first end adapted to receive an unsheathed portion of a tendon therein and a second end adapted to receive an unsheathed portion of another tendon therein; and a cover extending over said splice chuck, said cover having one end extending outwardly of said splice chuck and having a narrow diameter portion adapted for liquid-tight engagement with a sheathed portion of one of the tendons, said cover having a cap member formed at an opposite end of said splice chuck, said cap member adapted for engagement within a cap-receiving section of an anchor.

11. A connector for tendons of a post-tension system comprising:

a splice chuck having a first end adapted to receive an unsheathed portion of a tendon therein and a second end adapted to receive an unsheathed portion of another tendon therein; and a cover extending over said splice chuck, said cover having one end extending outwardly of said splice chuck and having a narrow diameter portion adapted for liquid-tight engagement with a sheathed portion of one of the tendons, said cover comprising:

a polymeric portion extending around a portion of a body of said splice chuck and an opposite end of said splice chuck and extending outwardly therefrom; and an elastomeric portion extending around another portion of said body and said one end of said splice chuck, said elastomeric portion overlapping an end of said polymeric portion in liquid-tight relationship therewith.

12. A connector for tendons of a post-tension system comprising:

a splice chuck having a first end adapted to receive an unsheathed portion of a tendon therein and a second end adapted to receive an unsheathed portion of another tendon therein; and a cover extending over said splice chuck, said cover having one end extending outwardly of said splice chuck and having a narrow diameter portion adapted for liquid-tight engagement with a sheathed portion of one of the tendons, said cover comprising:

a first elastomeric portion extending around a portion of a body of said splice chuck and around an opposite end of said splice chuck and extending outwardly therefrom; and a second elastomeric portion extending around another portion of said body and said one end of said splice chuck, said first elastomeric portion overlapping an end of said second elastomeric portion in liquid-tight engagement therewith.

13. The connector of claim 10, said cover having a narrow diameter neck portion extending to said cap, said cap having a thread portion adapted for threaded receipt within an anchor.

14. A method of forming an intermediate anchorage of a post-tension anchor system comprising:

extending a tendon with one end of said tendon affixed to a first anchor and another end affixed to a second anchor;

pouring concrete over said tendon;

solidifying said concrete around said tendon;

tensioning said tendon such that an unsheathed portion of said tendon extends outwardly of said second anchor;

affixing a splice chuck to said unsheathed portion of said tendon in liquid-tight relationship therewith; and affixing another tendon into said splice chuck such that said another tendon extends outwardly from said splice chuck in liquid-tight relationship therewith.

15. The method of claim 14, further comprising:

affixing a cover over said splice chuck such that one end of said cover extends in liquid-tight relationship with a sheathed portion of another tendon.

16. The method of claim 15, further comprising:

forming said cover with a connector section at another end of said cover; and engaging said connector section with said second anchor such that said second anchor, said connector section and said splice chuck extend over said unsheathed portion of said tendon.

17. The method of claim 14, further comprising:

affixing a third anchor onto an opposite end of said another tendon from said splice chuck;

pouring concrete over said splice chuck and said another tendon;

solidifying the concrete poured over said splice chuck and said another tendon; and tensioning said another tendon such that an unsheathed portion of said another tendon extends outwardly of said third anchor on an end opposite said splice chuck.

18. The method of claim 14, further comprising:

placing a splice chuck within a polymeric portion of said cover, said polymeric portion having an opening at one end; and extending an elastomeric portion in overlapping liquid-tight relationship to said polymeric portion and over said splice chuck, said elastomeric portion having an opening at an opposite end of said splice chuck.

* * * * *